United States Patent [19]

Frazier

[11] 4,018,608

[45] Apr. 19, 1977

[54] INFRA RED PHOTOGRAPHY WITH SILVER HALIDE FILMS USING INFRARED AND VISIBLE LIGHT EXPOSURES

[75] Inventor: Gene F. Frazier, Washington, D.C.

[73] Assignee: Versar, Inc., Springfield, Va.

[22] Filed: Oct. 10, 1975

[21] Appl. No.: 621,311

[52] U.S. Cl. ..... 96/27 E; 96/27 R; 96/45.2; 250/316; 250/330

[51] Int. Cl.[2] ..... G03C 5/04; G03C 5/32

[58] Field of Search ..... 96/45.2, 27 R, 27 E; 250/316, 330

[56] References Cited

UNITED STATES PATENTS

| | | | |
|---|---|---|---|
| 3,121,792 | 2/1964 | Mittelstaedt | 96/45.2 |
| 3,224,877 | 12/1965 | Jacobs | 96/45.2 |
| 3,685,997 | 8/1972 | Kellogg et al. | 96/45.2 |
| 3,811,885 | 5/1974 | Marchant et al. | 96/27 R |
| 3,884,552 | 5/1975 | Gerharz | 250/330 X |
| 3,953,210 | 4/1976 | Hasegawa et al. | 96/45.2 |

OTHER PUBLICATIONS

Mees, "The Theory of the Photographic Process", 4, 1966, p. 157.

*Primary Examiner*—Edward C. Kimlin
*Attorney, Agent, or Firm*—Dowell & Dowell

[57] ABSTRACT

A process for photographing infra red events onto silver halide film including the steps of focusing the infra red radiation directly onto the film to alter the sensitivity of the film to visible light, then flashing the film with a uniform field of visible light at the moment when the sensitivity-altering effect of the infra red is optimum, thereby producing a latent image whose density when developed will vary with the interrelationship between the integrated exposure of the film to infra red and to visible radiation at various discrete areas of the film.

10 Claims, 6 Drawing Figures

10
11
12
14
16
18
19
20
22
23
SHUTTER
POWER SUPPLY
CO, CO2 LASER
(IR)
(VISIBLE)
VISIBLE LIGHT SOURCE
SHUTTER
FILM PLANE (POSITIVE PRINT)

(NEGATIVE FILM)

FIG. 6.

| EXAMPLE NUMBER | MICROMETER $\lambda_{IR}$ | SECONDS $E_{IR}$ | SECONDS $E_V$ | MW/MM$^2$ $I_{IR}$ | MW/MM$^2$ $I_V$ | TYPE FILM |
|---|---|---|---|---|---|---|
| 1 | 10 | 6 | 1.5 | 10 | .1 | a |
| 2 | 10 | 3 | 1 | 10 | .3 | c |
| 3 | 10 | 10 | 1/2 | 4 | .3 | a, c, d |
| 4 | 10 | 10 | 1/25 | 4 | .3 | c |
| 5 | 10 | 8 | 1/50 | 4 | .3 | f,g,e |
| 6 | 10 | 5 | 1/50 | 5 | .3 | f,g,h |
| 7 | 10 | 5 | <1 | 5 | .1 | c,d |
| 8 | 10 | 10 | 1/25 | 3 | .3 | c |
| 9 | 10 | 10 | 1/50 | 4 | .3 | c,d |
| 10 | 10 | 10 | 1/15 | 3-5 | .4 | b |
| 11 | 10 | 11 | 1/50 | 3 | .2 | b,c |
| 12 | 10 | 5 | 1/50 | 7 | .3 | c,d |
| 13 | 10 | 11 | 1/50 | 3 | .2 | b,c |
| 14 | 10 | 10 | 1/2 | 4-6 | .3 | c |
| 15 | 5 | 10 | 1/25 | 4 | .3 | c |
| 16 | 5 | 5 | 1/25 | 6 | .3 | c |
| 17 | 5 | 5 | 1/25 | 5 | .3 | c |
| 18 | 10 | 3-12 | 1/50 | 2,4,6,8 | .3 | c |
| 19 | 10 | 3-12 | 1/50 | 4 | .3 | c |
| 20 | 10 | 3-12 | <1 | 4 | <.1 | c |
| 21 | 5 | 5 | 1/25 | 6 | .3 | c |
| 22 | 10 | MULTI | <1 | 3 | <.1 | c |
| 23 | 5 | MULTI | <1 | 4 | <.1 | c |

INFRA RED PHOTOGRAPHY WITH SILVER HALIDE FILMS USING INFRARED AND VISIBLE LIGHT EXPOSURES

This invention relates to a method of photographing infra red events using silver halide films which have in the past been considered insensitive to infra red radiation, and more particularly relates to a method of photographing such events which includes the steps of exposure of the film to an infra red event, together with either concurrent or subsequent exposure thereof to a field of visible light, and then developing the film.

BACKGROUND AND PRIOR ART

A typical photographic film of the type which is most commonly used in photography comprises a silver halide in crystal state appearing as a grain suspended in a gelatin emulsion. The emulsion usually comprises animal fats and protein supplying amino acids which participate in the photographic process in a manner believed to take place as follows. The silver halide crystals, for instance silver bromide, are removed from the emulsion during developing of the film unless the silver is converted to metallic form as a result of exposure to radiation. When exposed to visible light the silver bromide grain is bombarded with photons whose energy is sufficient to cause photoelectrons to be ejected from the valence band of the halide crystals with energy proportional to the energies of the arriving photons. These photoelectrons are ejected from the valence band of the silver halide into the conduction band and they migrate to a trapping region and combine with silver ions to form metallic silver. However, this combining is not irreversible, the metallic silver thus formed being only metastable. In the absence of the proper emulsion, these halides would tend to recombine with the silver, and the effect of the exposure to visible light would be lost. However, the emulsion tends to prevent such recombination. The halide ions are highly mobile and tend to migrate to the edge of the grain where they are absorbed by the gelatin of the emulsion. The emulsion digests the halogen in a way which is imperfectly understood, thereby effectively removing it from the grain and preventing it from destroying the latent image. The lattice site after photoejection is often referred to as a hole. These holes have a degree of mobility which is many orders of magnitude greater than the silver ions, and if they were not removed from the grain, these holes would recombine with electrons and destroy the image. The holes are stabilized by the emulsion and subsequently removed from the grain, thereby leaving the electrons with no place to go except to the silver ions where they form silver aggregate. If enough silver aggregate is formed at a trapping region, this region will become a developable image site which will remain developable in a latent state for some time.

There is a phenomenon known as the Herschel Effect which employs exposure to infra red light in the near region at wavelengths up to about 1.2 microns to selectively disperse latent image sites formed by prior exposure to visible light, thereby to record infra red events on silver halide-type films. According to this well known prior art process, a photographic film is first exposed to visible diffused light so that it is sensitized (fogged by light) uniformly across its surface, i.e., the sensitization being latent because the film is not yet developed. This means that in the grain, enough photoelectrons have been ejected to form upon the grain sites of silver aggregate which could be developed. According to the next step in the Herschel teachings the film is then exposed to near infra red radiation. In the areas of the film where no infra red is focused, the film retains its original fogged exposure, but in the areas where the infra red exposure is sufficiently concentrated this radiation impinges upon the grain sites and excites the aggregate to such an extent that the photoelectrons are dispersed from concentrated sites on the grain, whereby in these areas the original exposure to visible light to form a latent image is reversed, and the film when developed has lost the densifying effect of the original exposure to visible light. Thus, the image on the film when developed will show a gradation of density which varies inversely as the intensity of its exposure to the near infra red radiation. This Herschel Effect thus involves a subsequent reduction of photographic density (blackening) by subsequent exposure to near infra red, as is extensively discussed in the prior art, for example, in Patent 2,912,325 to Maurer, which cites literature also discussing the Herschel Effect.

It is also known to initially chemically desensitize a silver halide film, for instance for use in a photocopy machine, and then at the same time of its use to heat the film using infra red to re-sensitize it, and then exposing it while heated to an image to be reproduced. This type of process is recited in U.S. Pat. No. 3,250,618 to Stewart et al.

THE INVENTION

The present invention is believed to operate in a manner which is fundamentally different from the Herschel Effect. As pointed out above, the Herschel Effect involves initial visible exposure of the film, followed by exposure to infra red light which partially desensitizes the film to reduce the density when it is chemically developed in areas where the infra red radiation has dispersed the latent image. Conversely, according to the present invention, the film is first exposed to the infra red radiation, and then it is either subsequently or concurrently flashed with a field of visible light prior to developing. The film is thereby considerably fogged by the subsequent visible light exposure in regions which were unaffected by the infra red image previously focused on the film, but remains less fogged or more fogged by the subsequent flash of visible light in areas of the film which were initially exposed to the infra red component.

As pointed out above, the exposure of ordinary silver halide film to visible light ejects photoelectrons from the silver halide valence band, which photoelectrons are then combined with the silver ions to form metallic silver. It was further mentioned that it was quite necessary to remove the halide ions from the vicinity of the silver grain in order to prevent recombination of the halide with the silver in view of the fact that the silver in the metallic form is only metastable. This removal of the halide is accomplished by the gelatin which stabilizes and effectively removes them from proximity with the silver ions.

The present inventive process is believed to be based upon using infra red radiation to excite exposed portions of the gelatin sufficiently to render it incapable of capturing the halide, or alternatively preventing trapping of the holes associated with the halide, whereby in these excited regions of the gelatin where the halide or holes are not removed, they will re-enter the grain and destroy the image sites. This theory of operation is supported by the fact that the gelatin emulsion has some very strong absorption bands within the infra red region where tests of the present invention have been conducted. Although the Herschel Effect is limited to the near infra red region and falls off at about 1.2 microns wavelength, the present effect is good to much longer wavelengths including at least 10.6 microns, and perhaps beyond to approach the far infra red region. The emulsions tested have had very strong absorption bands extending up into this region, one of the absorption bands being around 5 microns and the other being around 9 microns wavelength and beyond. The film in unexposed condition is initially exposed to the infra red radiation, for instance at a wavelength beyond that to which the silver halide is sensitive. It is believed that the emulsion itself is excited in the areas of infra red exposure, that is, in the sense that the impinging infra red photons excite the emulsion vibrationally and rotationally so that the emulsion components experience such a change in their energy levels that their ability to stabilize and absorb the halide atoms and holes is very substantially reduced. Since the life of this excitation is fairly brief, the effect of exposure to infra red tends to fade out fairly rapidly if immediate advantage is not taken of it. Thus, the film should be flashed with visible light during the interval of time when the emulsion is excited to its optimum degree, and according to experience, the best results are obtained when the film is flashed with visible light for a time which overlaps the end of its exposure to the infra red radiation. In one set of experiments, the film was flashed at different times with respect to the interval of infra red exposure, and it was found that the longer the interval between the end of the infra red exposure and the flashing of the film with visible light, the poorer the resulting infra red image when the film was developed. As mentioned above, flashing the film so that the flash interval somewhat overlaps the end of the infra red exposure produced the best results. An infra red image could still be obtained when the flash occurred as much as two and one half seconds after infra red exposure, but with a 20 second delay between the infra red exposure, but with a 20 second delay between the infra red exposure and the visible light flash, there remained no manifestation of the infra red effect, and one obtained only the uniform grey shading produced by flashing the film with visible light.

THE OBJECTS OF THE INVENTION

It is the principal object of the present invention to provide a direct, rather than a two-stage indirect method of recording infra red events. Several of the principal prior art methods currently used to record infra red images at wavelengths beyond the range of the Herschel Effect use a two-stage approach which employs an intermediate display means which is sensitive to infra red radiation, and which produces a visible effect on its surface which can then be photographed by ordinary film. For instance, the intermediate display may comprise a liquid crystal display which changes color upon impingement by infra red radiation because the display is heated thereby. This change of color can then be photographed. Another common type of display is the image-plate phosphor display in which a chemically coated plate has its appearance changed by infra red impingement, and this change of appearance forms an image which can then be photographed, providing the photographing takes place immediately. Both of these forms of prior art display provide adequate sensitivity and resolution, but both of them are awkward to use and provide images which are very ephemeral. They must, of course, be immediately photographed in order to preserve them. However, there is considerable distortion introduced by such intermediate displays, which comprise a separate step in the process. An infra red bolometer can be raster-scanned to produce an image, but this is rather a slow process.

Another major object of the invention is to provide a technique of infra red photography which is effective further into the infra red region beyond 1.2 microns. It is believed that the present invention works in this region because the emulsion has the capability of being excited by the infra red radiation, whereas the Herschel technique fails in this region because the silver aggregate in the grain absorbs so little energy from the infra red radiation that the photoelectrons converting the silver ions to aggregate are not dispersed by the radiation to an appreciable extent.

Another object of this invention is to provide an extended infra red photography method which provides an image which is stable and can be developed at one's convenience at a subsequent time without loss of the image in the meanwhile. Several of the techniques described above use intermediate displays on which the image persists for only an interval of 0.1 to 5.0 seconds, although as mentioned above they can be photographed. However, the use of the intermediate display greatly increases the complexity of image formation, as well as the congestion of instruments in the vicinity of a phenomenon to be recorded on film.

Still another object of the invention is to provide a photography method useful in the infra red region which is inexpensive in view of the fact that it can be accomplished using ordinary drug store film. In the past, there have been some special infra red sensitive films developed, for instance, using dyes which absorb more energy in the infra red spectrum, but these films are much more expensive than ordinary photographic films. As stated above, the Herschel Effect approach, while using ordinary films, is ineffective beyond about 1.2 microns wavelength in the near infra red region.

The present photographic process is useful for a wide variety of investigations including such events as photographic recording in plasma physics, the location and identification of plasma fields, analysis by spectrum, determining of refractive index, the selective identification of materials, and the study of rocket and engine exhaust phenomena.

Other objects and advantages of the invention will become apparent during the following discussion of the drawings.

THE DRAWINGS

FIG. 6 is a table showing the parameters involved in the running of 22 listed tests comprising the EXAMPLES discussed below.

Figure 1:
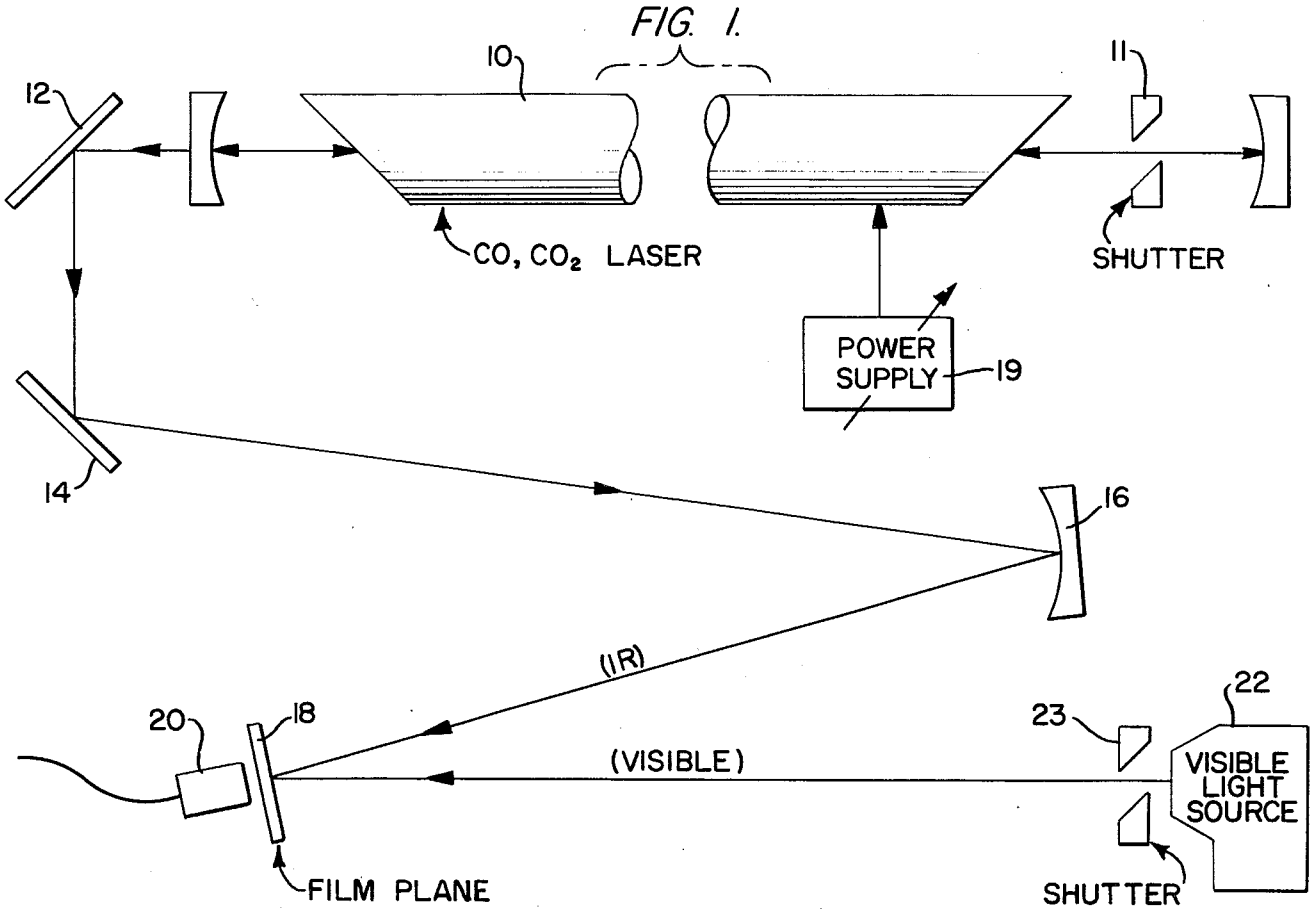
FIG. 1 is a schematic diagram showing an experimental layout of apparatus for performing the process according to the present invention.

Referring now to FIG. 1, this figure shows an experimental setup used for the purpose of taking data while developing the present process. The setup includes an open cavity laser 10, for instance of the CO or the $CO_2$ variety, respectively providing radiation in the five micron or in the ten micron wavelength region depending upon which laser was used. Flat mirrors 12 and 14 serve to direct the output from the laser to a concave mirror 16 which then focuses the laser beam along its optical axis to the photographic film 18. The power delivered by the laser to the film was monitored using a calibrated PY-3 Harshaw detector 20. The irradiance energy specifications measured in these observations are those found at the center of the beam spot. Irradiance at the focal plane was measured at 10 to 15 minute intervals as a check for the laser power stability, which was found to be better than 5%. The infra red intensity was altered by changing the gas proportions in the discharge tube and by adjusting the current from the power supply 19 to the laser. A tungsten light source 22 was used to flash the photographic plate 18 through a shutter 23, the visible light source 22 having been placed at 2 meters from the film 18. This distance was found by experiment to produce good background density with an exposure time of 1/50 second for Polariod-type 55 PN film. The integrated output of the visible light source 22 was roughly 0.2 microwatts per square millimeter, the visible radiation being in the vicinity of 0.4 – 0.7 microns wavelength. Both the visible source 22 and the IR laser were shuttered so as to ensure repeatability of the exposure intervals. The use of the shutters 11 and 23 proved to be essential to permit very accurate control of exposure intervals. Various films were used to check the general concepts of the method, but Polaroid emulsions were explored at length because of their convenience. Ordinary wet-process films were used to prove that similar effects should be observed using other common films.

Essentially, the photographic exposure is initiated using completely unexposed film, whereupon the film is first exposed to an infra red image, and then it is either concurrently or subsequently exposed to the visible light source. The length of these exposures will of course depend upon the film type, the laser power, and the intensity of the visible light source. Visible light exposures during tests were generally in the range of 1/25 second duration or less, and it was found that a 1/50 second duration was the most satisfactory with Polaroid 55 PN film. The purpose of this exposure after the initial infra red exposure is to freeze such effects on the film as were introduced by the initial exposure to infra red. Where the film has been strongly exposed to infra red, it becomes quite insensitive to visible light exposure apparently due to thermal destruction of the emulsion. On the other hand, where the film has been only slightly exposed to infra red, it tends to retain or improve its original sensitivity to visible light, with the result that the film is strongly affected by exposure to the visible light source. In between these two extremes, of course, the change in density of the image varies with the exposure, as will be presently discussed. Thus, within limits the effect of visible-light flashing of the film is to freeze the effects on the film of the infra red exposure which it has just undergone.

The best contrast is observed when the exposure to visible light actually overlaps the end of the infra red exposure time by a small amount so that the visible light exposure occurs at a time when the emulsion is most strongly excited by the infra red exposure.

Figure 2:
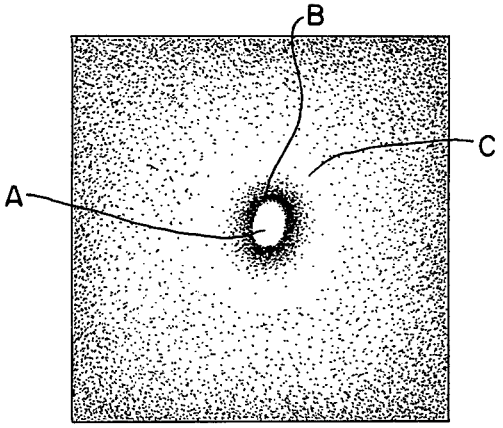
FIG. 2 is a view of a positive print of a photographic film exposed to a profile of varying IR intensity according to the present invention.
Figure 3:
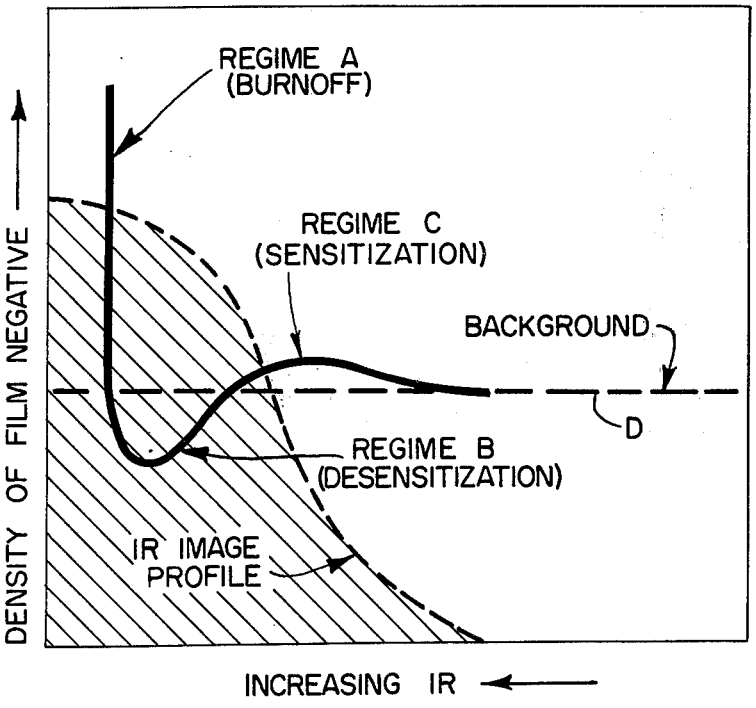
FIG. 3 is a graphical illustration of the effect of infra red radiation at different integrated levels impinging upon a negative film to provide a positive print according to FIG. 2.

FIGS. 2 and 3 are related to each other and will be discussed together. FIG. 2 shows a positive print made from a silver halide film which was exposed over its area to different intensities of infra red radiation according to the infra red energy profile shown in FIG. 3 and representing a negative film corresponding with the right-hand half of FIG. 2. It will be noted that on the horizontal axis of FIG. 3, infra red intensities of varying energy content are plotted against on the vertical axis density of the negative film when developed. The horizontal dashed line D extending across FIG. 3 shows the exposure density of the film attributable only to the flash of visible light, and this background density is the result of an exposure which was constant across the whole film area. In the very center of the picture marked A there is an extremely high degree of exposure of the film to infra red radiation, the exposure being at an energy level of 4 mw/mm$^2$ for 10 seconds, but the infra red radiation was focused on the film 18 in such a way that it fell off to a lesser exposure in area B and to a still lesser level in area C, and finally to an ineffective level in the outer area beyond the area C. At the end of this infra red exposure, a 1/50th of a second white light exposure was added using the tungsten source 22 described above. This source of visible light produces the background shading in the absence of infra red radiation of density shown by dashed line D across FIG. 3 which corresponds with the outermost region of the positive print shown in FIG. 2. The film was darkened to a medium density in this area of least exposure to infra red.

It is to be noted that the emulsion in the center of the film was effectively destroyed and the film was completely blackened in this zone of maximum exposure. The infra red was, of course, most intense at its center, and fell off rapidly moving out from the center A of the picture as shown in FIG. 2. In the darkened ring zone B it will be noted that the film has been rendered substantially insensitive to visible radiation, and that this insensitivity proceeds toward greater sensitivity to visible light along the portion of the curve marked B and C in FIG. 3, eventually extending above the dashed line D and showing in that region an increase in visible light sensitivity exceeding that which would normally be expected with respect to the flash of white light. Thus, above the dashed line D the film has actually been rendered more sensitive to the flash of visible light than it would be in the absence of exposure to infra red. The increase in sensitivity may be attributable to mere warming of the film by the infra red to such an extent as to render it more sensitive to visible radiation, but the intensity of infra red radiation impinging upon the film in this region being less than what is required to excite the emulsion sufficiently to desensitize the film to visible radiation. The portion of the curve marked C then turns back down and joins the background level represented by the dashed line D, indicating that the rest of the film is experiencing normal sensitivity to the flash of visible light. The curve shown in FIG. 3 shows the effect of varying the intensity of the infra red radiation. This curve illustrates three different types of effects which the infra red radiation has upon the film, expressed as regimes.

Regime C is the first to be seen with increasing exposure. The negative is shown to be increasingly sensitized to visible light in the regions of infra red exposure. Thus, the negative shows higher density in these regions than the surrounding background represented by the line D.

With a more intense infra red exposure, regime B takes precedence over regime C. In this case the negative will show less density in the regions of infra red and visible exposures than the density marked by the background line D representing exposure to visible light only.

At the highest intensity of IR exposure labelled regime A effects similar to thermal burnoff appear. There is no obvious destruction of the emulsion until a very high IR exposure is reached, but in all cases these effects appear to be irreversible.

It was found that silver halide films other than Polaroid film, such as Kodak Panatomic-X and Plus-X displayed effects similar to those discussed above with regard to the Polaroid film. However, in each case, it is believed that the burnoff of the film under regime A as shown in FIG. 3 is a destructive effect rather than a photographic effect.

Extensive experiments were carried out under regimes B and C of the curve shown in FIG. 3, and these experiments achieved good contrast, especially after it was established that the visible flash of light should closely follow or overlap the end of the infra red exposure. The use of shutters for controlling exposure times and reducing scattered light also permitted the experiments to achieve a high level of reproducibility. The contrast achieved for negatives developed from the films exposed according to this invention was used as the basis of analysis, and this measurement was made by comparison with established standards of contrast. The statistical variation in background density was found to be less than 0.03 for each curve as shown in FIGS. 4 and 5.

Figure 4:
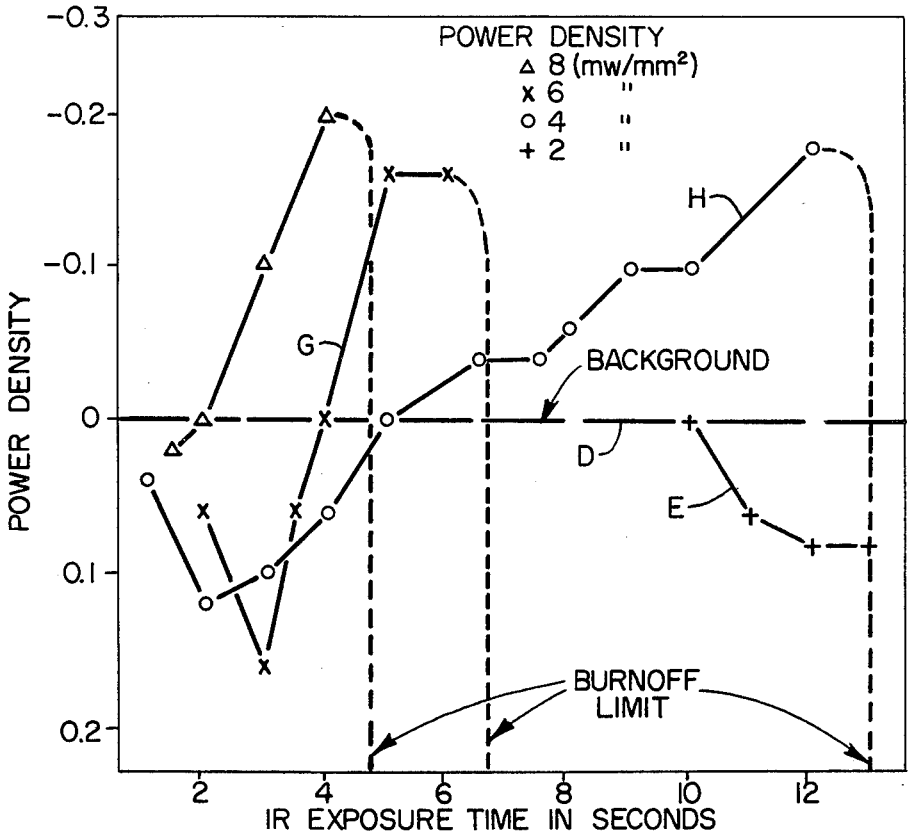
FIG. 4 is a graphical illustration showing developed density of the film versus infra red exposure time where the infra red exposure time is varied, but the flash or diffused white light is kept constant.

FIG. 4 shows the contrast in terms of density for Polaroid 55 PN film receiving radiation from a $CO_2$ laser. For each of these curves, the visible light exposure represented by the background dashed line D was maintained constant, while the infra red exposure for a constant power density was varied by varying its time. The infra red wavelength included components ranging from 9.2 to 10.6 microns. The visible light exposure was at a 50th of a second. The curve F shows exposure to infra red energy at a relatively high irradiance of 8 mw/mm$^2$, the destructive limit of the exposure being reached rather quickly after about 4 seconds. The destructive limit for the curve G representing an irradiance of 6 mw/mm$^2$ was achieved sometime later after about 6 seconds, whereas the destructive limit according to the curve H representing an irradiance of 4 mw/mm$^2$ took very much longer to reach, namely about 12 seconds. For the curve E, representing an irradiance of 2 mw/mm$^2$, the destructive limit was not reached at all. These curves would seem to indicate that for low infra red exposures, in regime C, a moderate increase in film temperature is responsible for the observed increased sensitivity of the film. At higher energy levels the desensitization effects shown on the portions of the curves loacted above the dashed line D are dominant, but it appears that these two effects are opposed to one-another.

Figure 5:
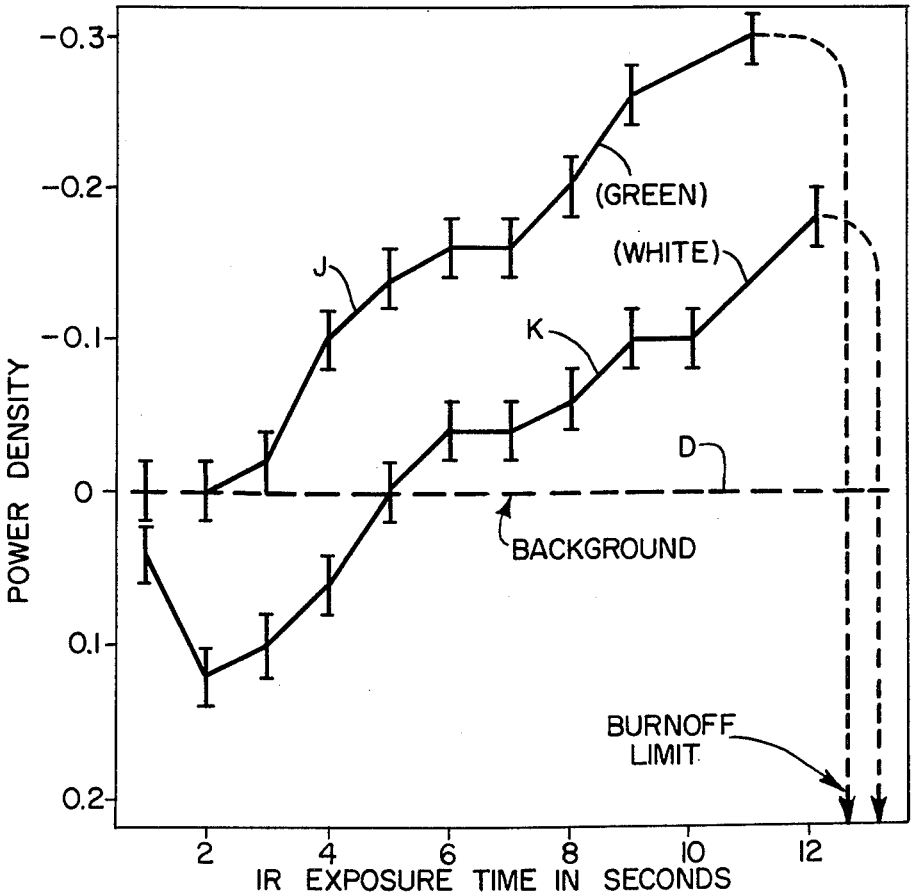
FIG. 5 is a graphical illustration showing developed density of the film for increasing infra red exposure time using two different colors of visible light to flash the film subsequent to its infra red exposure.

FIG. 5 shows the effect of varying the wavelength of light from the visible source 22. With regard to the curve J as shown in FIG. 5, a green filter was used to restrict the visible component to wavelengths of 0.56 to 0.57 microns. By comparing the curve J with the curve K for white light of the same intensity, it will be noted that the use of green light improves the contrast by a rather considerable amount which amount is nearly constant over the length of the curve. Other tests using red light produced enhanced sensitization effects in all cases. From this, it is concluded that the desensitizing effect represented by the portions of the curves located above the dashed line D is always in opposition with the sensitizing effect shown in the portions of the curves located below the dashed line D, the balance between the two effects shifting back and forth depending upon the infra red exposure time and upon the wavelength of the visible light source. It should be noted in FIG. 5 that the upper curve J is shifted mostly along the abscissa, and also that the regions in the upper curve J showing little desensitization effects correspond to the region of maximum sensitization for the lower curve K. These two facts would tend to indicate that changing the wavelength of the visible light source may be a method of reducing or selectively eliminating these opposing effects.

EXAMPLES

The following examples refer to FIG. 6 of the drawings, and provide representative illustrations of the present inventive method of infra red photography. The six parameters listed in the table as shown in FIG. 6 are as follows:

$_{IR}$ — Infra Red Wavelength
5 or 10 micrometer wavelength region radiation depending upon whether a CO or a $CO_2$ laser was employed to produce infra red radiation.

$E_{IR}$ — Infra Red Exposure Time
The infra red exposure time defined as the length of time in seconds during which the film was exposed to infra red radiation.

$E_v$ — Visible Exposure Time
The visible exposure time defined as the length of time in seconds during which the film was exposed to visible radiation.

$I_{IR}$ — Infra Red Irradiance
The infra red irradiance defined as the power density at the focal plane expressed in milliwatts/millimeter$^2$ (mw/mm$^2$).

$I_v$ — Visible Irradiance
The visible irradiance defined as the integrated (spectral) intensity expressed in microwatts/millimeter$^2$ (mw/mm$^2$) at the focal plane.

The film types used in these examples were:

a. Polaroid 107
b. Polaroid 108 (Color)
c. Polaroid 55PN
d. Polaroid 52
e. Kodak Plus-X
f. Kodak Tri-X
g. Kodak 2475 Recording
h. Kodak Panatomic-X EXAMPLE No. 1

This example was performed by apparatus as shown in FIG. 1 of the drawing using a $CO_2$ laser and exposing Polaroid 107 film to rather intense IR radiation of irradiance equaling 10 mw/mm² for six seconds, and then flashing the film with light from the tungsten source 22 at an irradiance of 0.1 mw/mm² for 1.5 seconds. This example was an early experiment and involved exposures greater than proved to be optimum in later experiments. However, the 10 micron infra red laser radiation was successfully photographed. In addition several target shadowgraphs were made in which an opaque object was inserted in the laser beam about four inches from the film to produce umbra and penumbra effects on the film.

EXAMPLE No. 2

This example used a bunsen burner flame as the source of infra red radiation and photographed it to produce a clear image which was also partly in the shadowgraph mode, the image having very good contrast, and the IR and visible light having been controlled as to exposure times, as shown in FIG. 6, by means of shutters.

EXAMPLES Nos. 3, 4, 5 and 6

These four examples were run with apparatus as shown in FIG. 1 using the parameters listed for them in FIG. 6. These runs tested a number of different types of commerically available films to show that the present process works for each of them, some of the film being color film and some being black and white. The resulting contrasts differed with different film types, and there was some indication that infra red events were better photographed by slow speed films, but in all cases the change in sensitization of the film by IR exposure prior to visible exposure was clearly evidenced.

EXAMPLE No. 7

This example was run for the purpose of establishing that the present process is not attributable to the Herschel Effect. For this purpose the film was exposed first to the visible radiation and then to the IR radiation in the 10 micrometer region. When the sequence of exposure was thus reversed with respect to the sequence in which the present process is normally carried out, no infra red effects at all were observed on the developed film.

EXAMPLES Nos. 8 and 9

This experiment was performed to show that the IR image is in fact frozen or preserved as a stable latent image by the subsequent exposure to visible light. In this experiment the developing of the film was delayed one hour after exposure, and no difference in density was observed when compared with control films which were developed immediately. These results were repeated using the parameters listed under Example No. 9, but delaying film development overnight.

EXAMPLE No. 10

This example employed color film to photograph a $CO_2$ laser beam. A striking image was produced in which the colors varied as the IR irradiance varied across the film with a distribution similar to that shown in FIG. 2. All three regimes ranging from burnoff in region A, through desensitization in regime B, to increased sensitization in region C were observed.

EXAMPLE No. 11

This example included a series of runs changing the moment of exposure to visible light, relative to the exposure to IR. When even a slight visible exposure was made prior to the IR exposure, it tended to obliterate the IR effect on the film when developed. However, when slight visible exposure was made during the IR exposure it tended to somewhat enhance the infra red image when developed. The irradiance of the slight visible exposures mentioned above did not exceed 0.1 microwatt/mm².

EXAMPLE No. 12

This example employed film which had been refrigerated and whose temperature was about 0° C at the time of its exposure. These runs confirmed that in every case a lowering of the initial film temperature reduced the effectiveness of IR upon the film. The desensitization of the film to IR tends to be suppressed as well as the tendency toward burnoff because the film is chilled and therefore more IR energy would be needed to produce an effect equal to that produced in warmer film. However, the pre-chilling of the film tended to eliminate the possibility that thermally destructive effects might be responsible for desensitization in regime B.

EXAMPLE No. 13

This example used the same parameters as listed in FIG. 6, for Example 11, but involved the taking of black and white spectrograms and color spectrograms using Polaroid film type 108 employing a grafting to disperse the IR radiation of both CO and $CO_2$ lasers.

EXAMPLE No. 14

This example used the parameters as listed in FIG. 6 for taking interferograms of $CO_2$ laser radiation by passing the beam though an interferometer and impinging the interference lives upon the film located therebeyond. The film when developed provided very good fringe contrast.

EXAMPLE No. 15

This example, and the next two, were performed using a CO laser providing IR radiation in the five micron region. Photographs taken were of the type shown in FIG. 2 and exhibited very good contrast in the desensitization region referred to as regime B.

EXAMPLE No. 16

This example includes further tests of the type referred to in FIGS. 1, 2 and 3, but using laser radiation in the five micron region, and each test exhibited all three regimes. In one series of these runs the moment of occurrence of the exposure to visible light was delayed, in one second steps, following the IR exposure, and it was observed that as the delay increased the infra red effect as seen in the developed film was decreased. When the delay reached about 5 to 7 seconds the effect of the infra red exposure was about lost. However, the burnoff effect in regime A was observed to remain after all of these runs and was fully irreversible. Other runs were made after allowing the film to remain in a high-humidity atmosphere for 8 hours. This humidification of the film enhanced the effect of the IR exposures over freshly opened film.

EXAMPLE No. 17

This example was run to show that the burn-off regime A is irreversible. In some runs film which was exposed to IR was developed without any visible light exposure. In other runs, the visible exposure was delayed, increased or decreased. In all cases, however, the negative in the burn-off area, regime A, showed the same value of optical density.

EXAMPLE No. 18

This example includes the parameters under which the curves of FIG. 4 were produced. In these runs, the film was exposed to constant IR irradiance (power density), but the exposure time to infra red was varied up to about 12 seconds. For curve F the irradiance was 8 mw/mm$^2$; for curve G it was 6 mw/mm$^2$; for curve H it was 4 mw/mm$^2$; and for curve E it was 2 mw/mm$^2$.

EXAMPLE No. 19

This example was used to obtain Schlieren photographs of bunsen burner flames and of the disturbed atmosphere in the vicinity of the flame. Such photographs show the cool non-visible flow of gas at the outer region of the flame. The laser beam is used to detect the cool cone exterior to the visible flame cone which is then photographed using the Schlieren Effect.

EXAMPLE No. 20

The runs made according to these parameters were used to obtain the curves shown in FIG. 5 in which a $CO_2$ laser was used to provide 10 micron IR radiation to which Polariod 55PN film was exposed with an irradiance of 4 mw/mm$^2$, and then the film was exposed in various runs to different colors of visible light. It was observed that green exposures (curve J) produced an improvement in desensitization contrast over film which had been exposed to the same infra red radiation density but then to broad banded visible light (curve K). It is clear from this figure that the improvement is nearly constant and therefore is independent of the infra red power density or exposure time. The curves produced by red light (not shown) would lie below curve K and would be roughly symmetrical about K with curve J. A red curve shows that sensitization contrast is greatly improved over a curve produced with broad banded visible light. Hence different colors of visible exposure produce different results in regimes B and C.

EXAMPLE No. 21

Further runs were made change the wavelengths of the visible exposures. If green or blue light was used desensitization effects (regime B) became dominant over sensitization effects (regime C), whereas red light exposures tended to have the opposite effect.

EXAMPLE No. 22

This example embodied a number of test runs to determine whether or not the IR pictures made according to the usual method according to this invention could be enhanced by pre-conditioning the film by means of a prior exposure to the same infra red image followed by an interval of non-exposure, all preceeding the sequence of usual exposures made according to the present method. In each of these runs, the usual exposures were to an infra red image for 3 seconds immediately followed by visible light exposure of duration equalling one second. In a first series of control runs, these two exposures were the only exposures and resulted in pictures having the expected contrast for the IR image. On the second series of runs, these usual exposures were unchanged, but they were on each run preceeded by a preliminary exposure of three seconds to the same infra red image, followed by a delay of about six seconds (the natural relaxation time of the infra red effect) before beginning the usual exposure sequence. On a third series of runs, the usual exposures were unchanged, but were on each run preceeded by a longer preliminary exposure to IR of ten seconds to said infra red image, followed by a delay of 8 seconds before beginning the usual exposure sequence. In both the second and third series of runs, the contrast achieved for the IR image as compared with background density was enhanced by said preliminary IR exposure which appeared to have a preconditioning effect on the film. The improvement in contrast varied from 5 to 50% depending upon the preconditioning steps used.

EXAMPLE No. 23

The runs made for Example 22 were repeated here using a CO laser emitting radiation in the 5 micron region.

This invention is not to be limited to the exact embodiments and steps set forth in the above disclosure and Examples, for obviously changes can be made within the scope of the following claims.

I claim:

1. The method of photographing an infra red event to provide a lasting developable latent image upon a film which is of a visible-light sensitive type having a silver halide grain suspended in an emulsion, comprising the steps of:

impinging an image of the infra red event on the film which is initially unexposed to visible light, the infra red exposure being made with sufficient intensity and for an exposure interval sufficient to excite areas of the film which are the most intensely exposed to the infra red beyond the degree of excitation which increases its sensitivity to visible light by merely warming it, to a greater degree of excitation which reduces the sensitivity of the film upon exposure to visible light by reducing the ability of the grain to form a stable latent image in the presence of the excited emulsion; and exposing said film after it has been excited by the infra red and while still excited to a field of visible light whose intensity and duration is such as to produce a developable latent image having, when developed, graduated contrast wherein the densities are functions of the degree of excitation of said areas by the infra red exposure.

2. The method as set forth in claim 1, including the further step of developing the film to provide an image thereon corresponding with the latent image of the infra red event.

3. The method as set forth in claim 1, wherein the step of exposing the film to visible light is performed so that it overlaps temporally, the last portion of said interval of exposure to infra red.

4. The method as set forth in claim 1, wherein the step of exposing the film to visible-light is performed immediately after the end of said interval of exposure to infra red.

5. The method as set forth in claim 1, wherein the intensity and interval of infra red exposure lie between an upper limit of exposure beyond which the film is damaged such that the effect on the film of the infra red exposure will not fade out as the excitation thereof subsides, and a lower limit where the film is not significantly excited.

6. The method as set forth in claim 1, wherein the maximum intensity of the infra red radiation does not exceed 10 mw/mm$^2$ and the interval of exposure does not exceed 12 seconds.

7. The method as set forth in claim 1, wherein the exposure to visible-light is to a broad band of colors approximating white light, and is of intensity not exceeding 0.3 mw/mm$^2$ and for a duration not exceeding one second.

8. The method as set forth in claim 1, wherein the film is black and white film, and the exposure to visible-light is selected such as would increase the density of the film when developed without prior infra red exposure to a uniform gray level intermediate the densities which would result from no exposure of the film on the one hand and full exposure of the film on the other hand.

9. The method as set forth in claim 1, wherein the exposure to visible-light is to a selected filtered color of light within the visible-light spectrum.

10. The method as set forth in claim 1, wherein the recited sequence of exposures to infra red and visible-light are preceeded by a preconditioning exposure of the film to the infra red event for an interval at least as long as the recited infra red exposure, and this preconditioning exposure being spaced from said recited sequence of exposures by at least 5 seconds.

* * * * *